United States Patent [19]

Benzschawel et al.

[11] 4,300,679

[45] Nov. 17, 1981

[54] SELF LOCKING FOLDER

[75] Inventors: Steven J. Benzschawel, Carol Stream; James F. Nauheimer, Chicago, both of Ill.

[73] Assignee: Container Corporation of America, Chicago, Ill.

[21] Appl. No.: 181,862

[22] Filed: Aug. 27, 1980

[51] Int. Cl.[3] ..... B65D 5/02

[52] U.S. Cl. ..... 206/424; 229/40

[58] Field of Search ..... 206/424, 450, 453; 229/40, 37 E

[56] References Cited

U.S. PATENT DOCUMENTS

| | | | |
|---|---|---|---|
| 3,116,005 | 12/1962 | Skaggs | 229/40 |
| 3,253,770 | 5/1966 | Black | 206/424 |
| 3,826,362 | 7/1974 | Staskus | 206/424 |
| 3,871,572 | 3/1975 | Skaggs | 206/424 |
| 4,090,607 | 5/1978 | McCall | 206/424 |

FOREIGN PATENT DOCUMENTS

| | | | |
|---|---|---|---|
| 196 | 10/1979 | European Patent Off. | 206/424 |

*Primary Examiner*—Joseph Man-Fu Moy

*Attorney, Agent, or Firm*—Richard W. Carpenter; Davis Chin

[57] ABSTRACT

A one-piece, self-locking paperboard mailing folder for books, or the like, including integral inner and outer wrapper members.

2 Claims, 8 Drawing Figures

SELF LOCKING FOLDER

SUMMARY OF THE INVENTION

The invention relates to mailing folders of the type used for the packaging of books or similarly shaped articles.

It is an object of the invention to provide a one-piece folder which includes both inner and outer wrapper members.

A more specific object of the invention is to provide a folder of the type described which includes air cells between the inner and outer wrapper members for cushioning the packaged product and including an integral inter-locking closure arrangement which does not require outside securing means.

These and other objects of the invention will be apparent from the examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
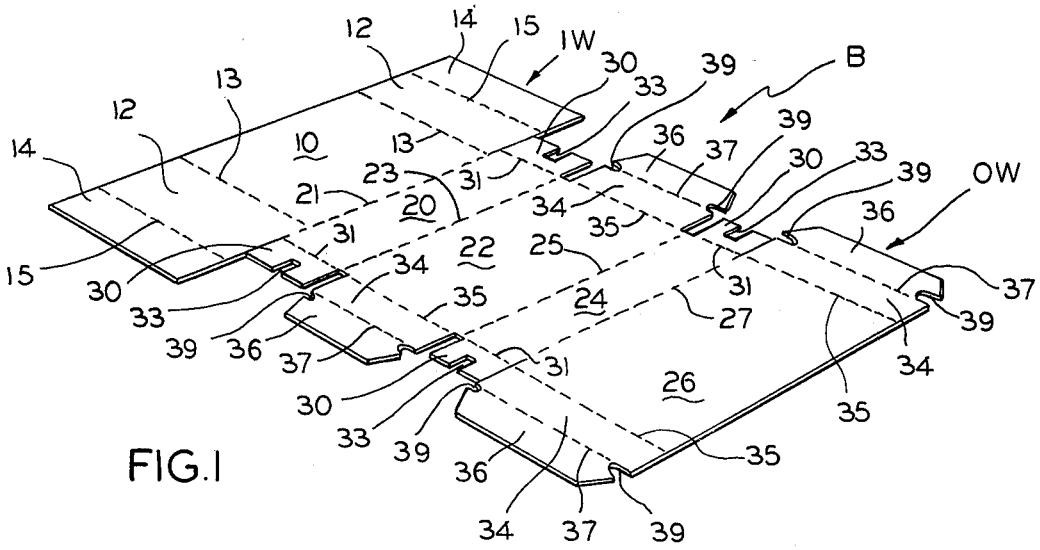
FIG. 1 is a perspective view of a blank of foldable sheet material from which the folder illustrated in the other views may be formed.
Figure 2:
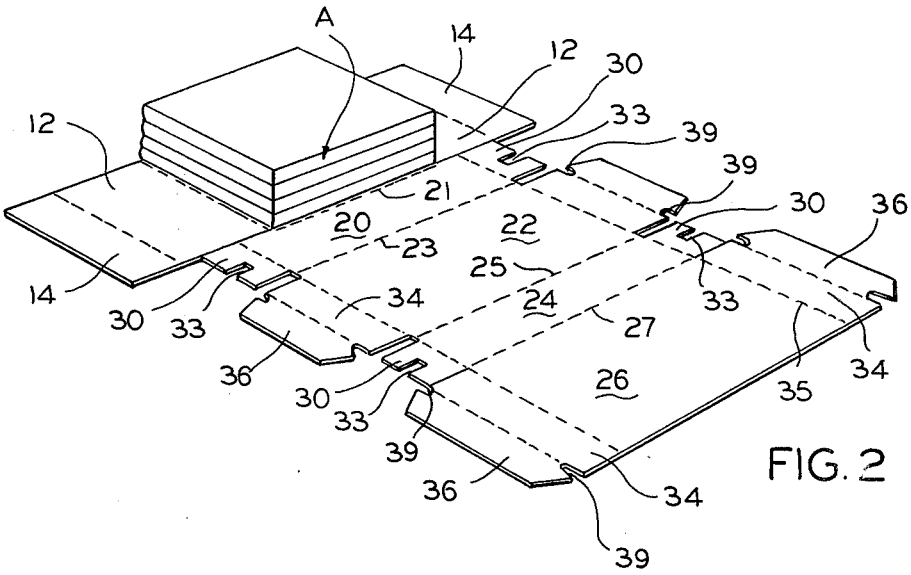
FIGS. 2, 3 and 4 are perspective views of the folder illustrated in FIG. 1 showing various stages in the formation of the erected folder.
Figure 3:
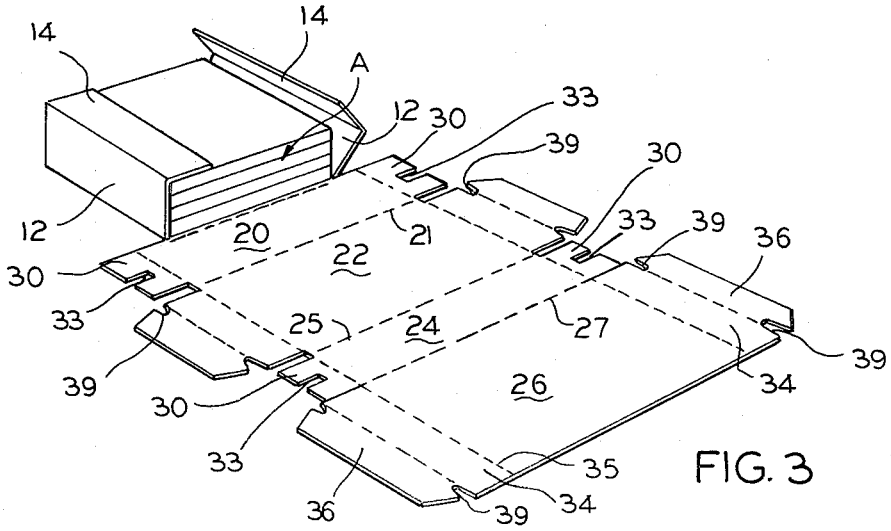
Figure 4:
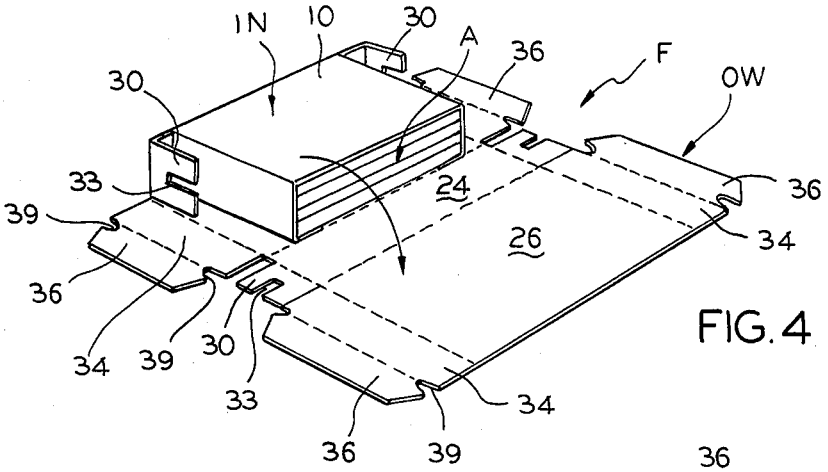
Figure 5:
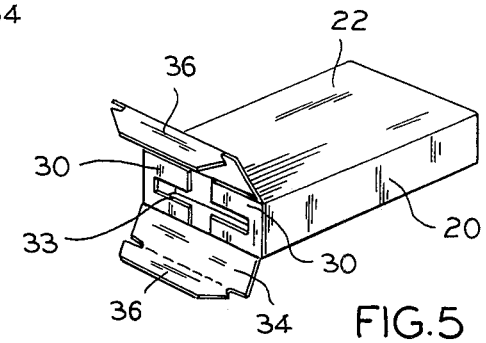
FIGS. 5 and 6 are views similar to FIGS. 2 through 4 and illustrate the manner in which the closure of the ends of the folder is effected.
Figure 6:
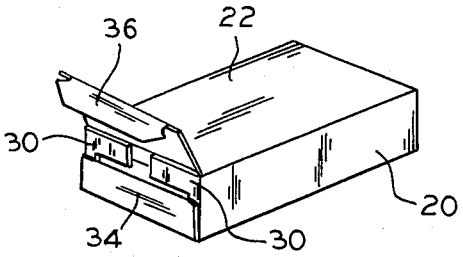
Figure 7:
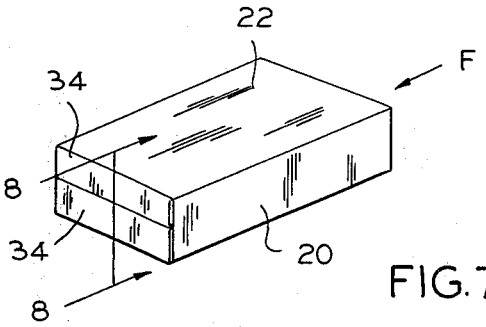
FIG. 7 is a perspective view of an erected, filled and closed folder embodying features of the invention.

Referring now to the drawings for a better understanding of the invention, it will be seen that the novel self-locking mailing folder indicated generally at F which is used for holding and transporting a plurality of articles A such as books or the like, and which includes inner and outer wrapper portion IW and OW, respectively, may be formed from a unitary blank B of foldable sheet material illustrated in FIG. 1. Inner wrapper IW, shown at the left hand portion of FIGS. 1, 2 and 3, includes a generally rectangular bottom panel 10. A pair of end panels 12 are foldably joined at their lower edges along fold lines 13 to opposite end edges of bottom panel 10 and have a pair of top panels section 14*a* and 14*b* foldably joined to their upper edges along fold lines 15. Top panel sections 14*a* and 14*b* are folded inwardly at right angles to end panels 12 and are co-planer with each other to form an interrupted top panel 14.

Outer wrapper OW, which is integral with inner wrapper IW, includes a first minor side panel 20, a first major side panel 22, a second minor side panel 24, and a second major side panel 26 which are foldably joined to each other along parallel fold lines 23, 25 and 27 to form a tubular structure open at the ends for enclosing inner wrapper IW after the inner wrapper has been erected around the packaged articles A.

It will be noted that inner wrapper bottom panel 10 is foldably joined along one side edge on fold line 21 to an adjacent side edge of outer wrapper first minor panel side 20 so that the inner and outer wrapper portions of the folder are integral with each other.

Turning now to FIGS. 4 through 8, it will be seen that the length of the inner wrapper is less than that of the outer wrapper so that when the ends of the folder are closed in a manner hereinafter described, air cells for cushioning the contents of the package will be provided between the inner and outer wrappers at the ends of the package. A pair of inner end flaps 30 are foldably joined along fold lines 31 to the opposite ends of each of the minor side panels of the outer wrapper. A pair of outer end flaps 34 are foldably joined along fold lines 35 to the opposite end edges of each of the major side panels. Foldably joined to the end edges of each of the outer end flaps 34 is a tuck flap 36. Thus to close the ends of the container, the inner end flaps 30 are folded at right angles to the minor side panels to which they are joined and the outer end flaps are folded inwardly at right angles to the respective major side panels to which they are joined. The tuck flaps 36 are then folded in face-to-face relation with each other at each end of the carton into the related slots 33 of inner end flaps 30. In order to maintain the tuck flaps 36 in locked position, they may be provided at opposite sides with notches 39.

Figure 8:
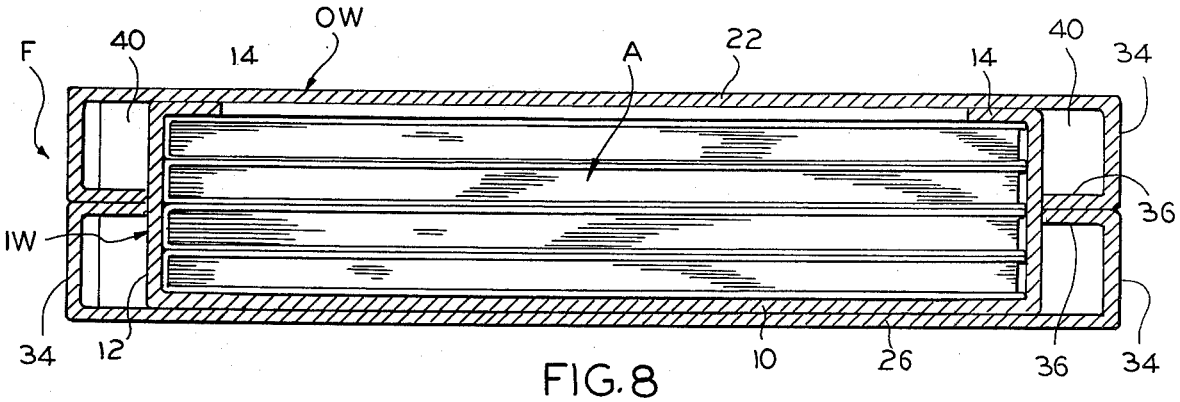
FIG. 8 is a longitudinal, vertical, sectional view taken in line 8—8 of FIG. 7.

Thus when the folded inner and outer wrapper portions have been completely erected, and the ends of the folder have been closed, as shown in FIG. 8, air cells 40 are provided at opposite ends of the folder between the inner and outer wrappers to cushion the contents of the folder.

It will therefore be understood that the invention provides a one-piece folder including integral inner and outer wrapper portions which have a completely self-contained inter-locking closure arrangement that also provides cushioning means for the contents of the folder.

We claim:

1. A self-locking, one-piece folder, for holding and transporting packaged articles such as books or the like, including integral inner and outer wrapper members, comprising:

(a) an inner wrapper member, for holding the packaged articles, comprising:
  (i) a bottom panel;
  (ii) a pair of end panels foldably joined to and upstanding from opposite end edges of said bottom panel;
  (iii) a top panel including a pair of co-planer top panel sections foldably joined at their outer edges to upper edges of said end panels and extending inwardly therefrom in parallel relation with said bottom panel;

(b) an outer wrapper member integral with said inner wrapper member, for holding the latter, comprising:
  (i) opposed pairs of minor and major side panels foldably joined to each other on parallel fold lines to form a tubular structure, open at the ends, for enclosing said inner wrapper member;
  (ii) said side panels extending beyond the ends of said bottom panel with one of said minor side panels being foldably joined along one edge to an adjacent edge of said bottom panel;
  (iii) each of said minor side panels having a pair of inner end flaps, foldably joined to opposite end edges thereof and having locking slots therein;
  (iv) said end flaps being folded inwardly from their related minor side panels in parallel relation with but spaced from a related inner wrapper member end panel to define an air cell therewith;

(v) each of said major side panels having a pair of outer end flaps foldably joined to opposite end edges thereof;

(vi) said outer end flaps at each end of said outer wrapper member being folded toward each other in co-planer relation and each having foldably joined thereto a tuck flap folded inwardly therefrom and received within slots of related inner end flaps to provide an interlocking closure arrangement.

2. A one-piece blank of foldable sheet material, such as paperboard, for forming a folder including integral inner and outer wrapper members, for holding and transporting packaged articles, such as books or the like, comprising:

(a) an inner wrapper member comprising:

(i) a bottom panel;

(ii) a pair of inner end panels foldably joined to outboard end edges of said bottom panel;

(iii) a pair of top panel sections foldably joined to outboard edges of adjacent end panels;

(b) an outer wrapper member, comprising:

(i) a first minor side panel foldably joined along one side edge to an adjacent side edge of said inner wrapper member bottom panel;

(ii) a first major side panel foldably joined along one side edge to another side edge of said first minor side panel;

(iii) a second minor side panel foldably joined along one side edge to another side edge of said first major side panel;

(iv) a second major side panel foldably joined along one side edge to another side edge of said second minor side panel;

(v) said bottom panel and said side panels being joined to each other along parallel fold lines extending generally normal to the fold lines joining the end panel to the bottom panel and the top panel sections;

(vi) inner end flaps foldably joined to outboard end edges of said minor side panels and presenting locking tab receiving slots therein;

(vii) outer end flaps foldably joined to outboard end edges of said major side panels;

(viii) locking tabs foldably joined to outboard edges of said outer end flaps.

* * * * *